United States Patent [19]

Toganoh et al.

[11] Patent Number: 4,542,059

[45] Date of Patent: Sep. 17, 1985

[54] RECORDING MEDIUM

[75] Inventors: Shigeo Toganoh; Ryuichi Arai, both of Tokyo, Japan

[73] Assignee: Canon Kabushiki Kaisha, Tokyo, Japan

[21] Appl. No.: 523,884

[22] Filed: Aug. 17, 1983

[30] Foreign Application Priority Data

| | | | |
|---|---|---|---|
| Aug. 23, 1982 | [JP] | Japan | 57-145882 |
| Aug. 23, 1982 | [JP] | Japan | 57-145883 |
| Aug. 23, 1982 | [JP] | Japan | 57-145884 |
| Aug. 23, 1982 | [JP] | Japan | 57-145885 |
| Sep. 3, 1982 | [JP] | Japan | 57-152807 |

[51] Int. Cl.[4] ..... B41M 5/00

[52] U.S. Cl. ..... 428/141; 346/135.1; 427/180; 427/261; 427/288; 428/144; 428/145; 428/148; 428/149; 428/150; 428/206; 428/211; 428/312.2; 428/318.4; 428/537.5

[58] Field of Search ..... 346/135.1; 428/195, 428/206–208, 211, 323, 537, 156, 141, 143–145, 148–150, 312.2, 312.6, 312.8, 318.4, 537.5, 327–331; 427/180, 261, 288

[56] References Cited

FOREIGN PATENT DOCUMENTS 0000157 1/1981 Japan ..... 428/195

OTHER PUBLICATIONS

JIS P 3801 (1956) Japanese Industrial Standard, Filter Paper (For Chemical Analysis).

JIS B 0601 (1976) Japanese Industrial Standard, Surface Roughness.

T 479 su-71 Smoothness of Paper (Bekk Method).

*Primary Examiner*—Bruce H. Hess

*Attorney, Agent, or Firm*—Fitzpatrick, Cella, Harper & Scinto

[57] ABSTRACT

A recording medium made of a substrate coated with a layer containing both a filler and a binder is characterized in that irregular shapes of filler particles appear at the surface of the coating layer.

34 Claims, 5 Drawing Figures

RECORDING MEDIUM

BACKGROUND OF THE INVENTION

1. Field of the Invention

This invention relates to a recording medium such as recording paper or the like for use in ink-jet recording or ink-transfer type thermal recording, and more particularly to a recording medium for such purposes which is excellent in ink absorptivity and coloration of image.

2. Description of the Prior Art

Methods of recording by use of recording liquids include, for instance, an old and general method: writing with a fountain pen or the like, and a recently developed method: so-called ink-jet recording. The ink-jet recording system is a recording method in which droplets of recording liquid are generated and expelled by one of various operation principles and applied to a recording medium such as paper or the like to form images. Ink-jet recording is noticed in that it generates less noises and permits high speed printing and multicolor printing. Water-based recording liquids are predominantly used for ink-jet recording in aspects of safety and printability.

For ink-jet recording, ordinary paper has so far been used in general as the recording medium. However, requirements on the medium are growing more severe with improvements in the performance of ink-jet recorders, such as developments of higher speed recorders and multicolor recorders. That is, for securing a high degree of resolution and high quality of images, the ink-jet recording medium must fulfill the following requirements:

(1) It should absorb ink as quickly as possible.

(2) When ink dots overlap one another on the medium, the later ink should not run on the earlier ink dot.

(3) Diameters of ink dots on the medium should not be enlarged more than necessary.

(4) Shapes of ink dots on the medium should be close to true circles and the outlines thereof should be smooth.

(5) Ink dots on the medium should have high optical density and the outlines thereof should not be obscure.

Further, the recording medium for multicolor ink-jet recording must fulfill the following requirements, in addition to the above, in order to achieve image quality comparable to that of color photographs:

(6) It should have a high brightness.

(7) Ink dots of different colors on the medium should each exhibit a good coloration.

(8) Ink absorptivity of the medium should be particularly superior since ink dots of different colors may often overlap one another.

The ink-transfer type thermal recording system has been developed lately, wherein wax-containing colorants (solid inks) are utilized. The recording medium for this recording system also is required to fulfill the above requirements. In particular, it is required when ink dots overlap one another that the earlier-applied dot of ink shall not be molten to diffuse with the heat applied for the next dotting or with the heat contained in the next dot of ink.

However, it is the present situation of the art that no recording medium satisfying all the above requirements has yet been found. As an example, the ink-jet recording paper described in Japanese Pat. Laid-open No. 74304/1977 quickly absorbs ink, but has disadvantages in that ink dots on the paper are liable to be enlarged in diameter and hence the outlines thereof become obscure, and that the dimensional stability of the paper is poor after recording.

SUMMARY OF THE INVENTION

The primary object of this invention is to provide a full-color-recording medium which satisfies such various requirements as noted above, and particularly has high absorptivity for ink and gives images of good colorations.

The above object and others are achieved with the various embodiments of this invention:

According to one aspect of the present invention, there is provided a recording medium made of a substrate coated with a layer containing both a filler and a binder, characterized in that irregular shapes of the filler particles appear at the surface of the coating layer.

According to another aspect of the present invention, there is provided a recording medium made of a substrate coated with a layer containing both a porous inorganic pigment and a binder, characterized in that irregular shapes of the porous inorganic pigment particles appear at the surface of the coating layer.

According to another aspect of the present invention, there is provided a recording medium made of a substrate coated with a layer, characterized in that the Bekk smoothness of the coating layer ranges from 20 to 120 seconds.

According to another aspect of the present invention, there is provided a recording medium made of a substrate coated with a layer, characterized in that the surface roughness expressed in the maximum height for a reference length of 2.5 mm, as measured in accordance with JIS B-0601, ranges from 10 to 35$\mu$.

According to another aspect of the present invention, there is provided a recording medium made of a substrate coated with a layer, characterized by having an ink absorption capacity of at least $7.0\times10^{-3}$ $\mu$l/mm$^2$.

DETAILED DESCRIPTION OF THE PREFERRED EMBODIMENTS

The recording medium of this invention is characterized by the unique surface state of its coating layer which acts as an ink acceptor. That is, the Bekk smoothness of the coating layer ranges from 20 to 120 seconds; the average value of maximum heights at 10 points selected at random on the surface of the coating layer, as determined in accordance with the JIS B-0601 method of measuring surface roughness, ranges from 10 to 35$\mu$for a reference length of 2.5 mm.

The coating layer has a surface structure such that the filler particles of irregular shapes and relatively large particle sizes, which are the main component of the coating layer, appear at the surface of the coating layer in the state of random distribution. And numerous large interstices, which act as ink absorbing pores, exist among the filler particles. Typical surface states of the coating layer are shown in FIGS. 1 to 4. These particles of the filler are of course fixed with the binder within the coating layer and therefore do not readily separate therefrom. The surface state, like scattered tile fragments of various sizes, is well shown by FIGS. 1 to 4, which are scanning electron microscopic photographs of magnification factor about 1500 of coating layer faces of recording media according to the present invention.

Figure 5:
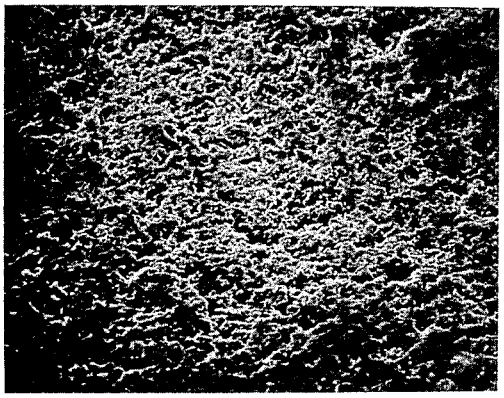
FIG. 5 is a scanning electron microscopic photograph of the same magnification factor showing a face of a commercially available art paper.

FIG. 5 is a similar photograph of a coating layer face of a conventional recording medium. This coating layer has a flat surface structure, while numerous fine pores serving as recording liquid absorbers are present in the layer, thus being clearly distinguished from that of the recording medium of this invention.

As stated above, the recording medium of this invention has numerous large interstices serving as ink absorbers among filler particles, so that the ink attached onto the medium surface is quickly absorbed into these interstices and also the ink absorption capacity of the medium is great.

When the Bekk smoothness of the coating layer is less than 20 seconds, the ink absorptivity is insufficient. On the other hand, when the value exceeds 120 seconds, the degree of resolution of the printed image lowers though the ink absorptivity is satisfactory.

When the maximum height representing the surface roughness is less than 10$\mu$, the ink absorptivity is insufficient. On the other hand, when the maximum height exceeds 35$\mu$, the degree of resolution of the printed image lowers though the ink absorptivity is satisfactory.

The ink absorption capacity defined in this invention is the value determined by the following method: Ink droplets of about 65$\mu$ in each diameter are discharged consecutively from an ink-jet recording head through 10 or more nozzles of 50 $\mu\phi$ aligned at regular intervals of 8/1 mm in the head and are attached onto a recording medium, which is moved relatively to the recording head where the amount of ink adhering to a unit area of the recording medium is varied by controlling the moving speed.

The recording medium having ink dots is passed, one second after the dotting, between a pair of rubber rolls under a line pressure of 200 g/cm, in which one of the rolls contacting with the coating layer of the recording medium is covered with a filter paper of a grade 5-A in accordance with the Japanese Industrial Standard, JIS-P-3801. By this procedure, the ink absorption capacity is measured by the maximum amount of ink that does not transfer to the filter paper Any existing commercial coated paper such as art paper indicates an ink absorption capacity of not more than $5.0\times10^{-3}$ $\mu l/mm^2$, as measured according to the above method. When such paper is used for multicolor ink-jet recording, the adhering ink may diffuse on the paper surface or the ink remaining on the paper surface may stain the recorder or the paper superposed. On the contrary, ink blots very considerably on plain paper having no such coating layer, although the ink absorption capacity of some paper is as high as $5.0\times10^{-2}$ $\mu l/mm^2$. Accordingly, shapes of ink dots are bad and clearness of the resulting images is low upon multicolor recording.

It has been found that such drawbacks of the existing recording media can be overcome with a recording medium which is provided with an ink-absorbing coating layer and has an ink absorption capacity of at least $7.0\times10^{-3}$, preferably $1.0\times10^{-2}$, $\mu l/mm^2$. Further, it is desirable that the coating layer by itself have said value or more of ink absorption capacity. The ink absorption capacity of the coating layer by itself can be approximately determined by forming the same coating layer on a substrate, such as a glass plate or plastic film, having no ink absorptivity and measuring its ink absorption capacity according to the above method.

While paper is usually the most suitable substrate of the recording medium of this invention, other substrates can also be used including porous materials such as cloth, synthetic paper, porous resins, wood, and the like and non-porous materials such as nonporous resins, metals, glass, and the like. The choice of the substrate from these materials depends upon the purpose and use of recording.

The ink absorbing layer of the present recording medium can be made of a porous resin as well as a mixture of filler and binder. When the ink absorbing layer of the present recording medium is made of a porous resin, either water-soluble resins or organic-solvent-soluble resin, formable into a film, may be used as raw material resin. Such water-soluble resins include, for example, poly(vinyl alcohol), starch, casein, gum arabic, gelatin, polyacrylamide, carboxymethylcellulose, sodium polyacrylate, and sodium alginate; organic-solvent-soluble resins include, for example, poly(vinyl chloride), poly(vinyl acetate), polyacrylonitrile, poly(methyl methacrylate), poly (vinyl formal), melamine resin, polyamide resins, phenolic resins, polyurethane resins, and alkyd resins.

Since the use of a water-soluble resin sometimes causes disadvantages such as large deformation of the medium due to moisture absorption or passage of ink through the medium, a water-proof treatment is applied, if necessary, to the porous resin layer The porous resin layer can be formed from the above-cited resin by the following processes:

(1) A material which will foam with heat or light is mixed and kneaded with the resin. The mixture is shaped into a film, which is then heated or exposed to light to form fine pores by bubbles in the resin.

(2) A dispersion of fine particles of inorganic water-soluble salt (e.g. sodium chloride) in the resin is shaped into a film. Then, the inorganic salt is eluted by soaking the film in water or by some other method to form fine pores in the matrix resin.

(3) A dispersion of fine particles of zeolite, silica, diatomaceous earth, or the like in the resin is shaped into a film. Then, the fine particles are eluted by soaking the film in an aqueous acid solution or by some other method to form fine pores in the matrix resin.

When process (2) or (3) is applied, any resin at least insoluble in water or in the aqueous acid can be used. For example, resins suitable for these processes are poly(vinyl chloride), polystyrene, polyacrylonitrile, poly(vinyl acetate), cellulose acetate, poly(vinyl butyral), acrylic resins, polyamide resins, styrene-butadiene latex, alkyd resins, poly (vinyl alcohol), polyester resins, and copolymers of monomers of these resins. Plasticizers suited for these resins can be added. Such plasticizers include, for example, dibutyl phthalate, dioctyl adipate, polyethylene glycol, and chlorinated paraffin In the porous resin layer thus formed, numerous pores arranged three-dimensionally are densely distributed at random. Most of these pores, in this case, communicate with one another, forming open cells. The size of these pores (pore diameter) is desired to be in such a measure that the capillary force acts effectively, that is, the pore diameters are designed to range from hundreds of Å to several $\mu$. The shape of these pores is not particularly restricted. In this invention, the size and geometry of these pores can be varied at will within the above range or scope, by controlling the preparation conditions and the process conditions.

The coating layer of the recording medium of this invention comprises basically a filler and a binder. Suitable materials for the filler are white inorganic pigments including, for example, silica, clay, talc, diatomaceous earth, calcium carbonate, calcium sulfate, barium sulfate, titanium oxide, zinc oxide, satin white, aluminum silicate, lithopone, alumina, and zeolite; and organic powdery materials including, for example, ion exchange resin powders and plastic pigments. These fillers can also be used in mixture. Among these fillers, porous inorganic pigments are particularly preferred.

For the purpose of forming the coating surface where filler particles irregular in shape are distributed at random like scattered tile fragments, particle sizes of the filler used are desired to range approximately from 1 to 30μ, preferably from 3 to 20μ. Too large particle sizes of the filler are undesirable, since the circularity of ink dots is deteriorated and the resolution degree of images is lowered, on the resulting recording medium. Filler particles of higher absorptivity for coloring matter and those having a porous structure are preferable. It is because the coloration is best when coloring matter in the ink applied to the recording medium is captured at outermost sites in the coating layer of the recording medium.

Binders for use in the coating layer include; water-soluble macromolecular compounds, for example, starch, gelatin, casein, gum arabic, sodium alginate, carboxymethyl cellulose, poly(vinyl alcohol), polyvinyl pyrrolidone, sodium polyacrylate, and polyacrylamide; synthetic rubber latexes; and organic-solvent-soluble resins, for example, poly(vinyl butyral), poly(vinyl chloride), poly(vinyl acetate), polyacrylonitrile, poly(-methyl methacrylate), poly(vinyl formal), melamine resin, polyamide resins, phenolic resins, polyurethane resins, and alkyd resins. If necessary, these polymers can be used in combination. Some of various additives such as a dispersing agent, optical brightener, pH regulator, deforming agent, lubricant, preservative, surfactant, etc. can also be incorporated into the coating layer The recording medium of this invention can be prepared by coating a substrate with a dispersion of the above-mentioned components of the coating layer in water by the roll coating, rod bar coating, spray coating, air knife coating method, or the like and drying the coat as quickly as possible. Suitable compounding ratios of the binder to the filler are 10:100–100:100 by weight. When the filler has a relatively large average particle size, better results are obtained by minimizing the amount of binder. Suitable amounts of the coating layer on the substrate are usually about 1–about 50 g/m$^2$, preferably about 2–about 30 g/m$^2$, in dry coating weight.

The recording medium of this invention, having a coating layer of a unique surface structure on a substrate, exhibits very high ink absorptivity; even when ink dots of the different color overlap one another in a short time, the phenomenon of elusion or bleeding of dotted ink does not occur on the recording medium, so that distinct images with a high degree of resolution are obtained. Additionally the images on the recording medium are excellent in coloration. Thus, the present recording medium is best suited for full-color ink-jet recording This invention is illustrated in more detail referring to the following Examples: In the Examples "parts" are all by weight.

EXAMPLE 1

A coating composition was prepared according to the following formulation:

| Formulation | |
|---|---|
| Silica (tradename: Nipsil E150, mfd. by Nippon Silica Ind. Co., Ltd. average particle size 5μ) as filler | 100 parts |
| Poly(vinyl alcohol) as binder | 25 parts |
| SBR latex as binder | 5 parts |
| Water | 500 parts |

Figure 1:
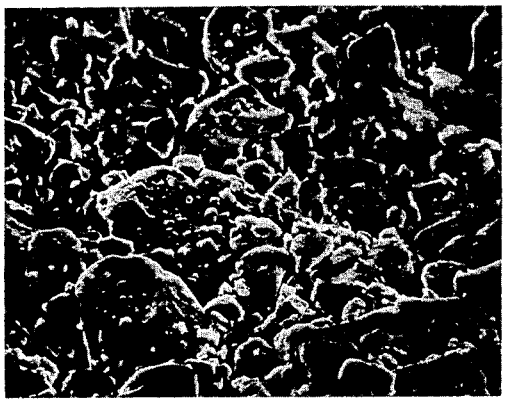
FIGS. 1 to 4 are scanning electron microscopic photographs of magnification factor about 1500 showing faces of the coating layer of the recording medium prepared in Examples of this invention.

Common wood-free paper (basis weight 65 g/m$^2$) having a size degree of 35 seconds as measured in accordance with JIS P-8122 was coated with the above composition by using a blade coater so as to give a dry coating weight of 15 g/m$^2$, and was dried in the usual way, whereby a recording medium was obtained. FIG. 1 is a scanning electron microscopic photograph of magnification factor ca. 1500 showing a face of the coating layer of the recording medium.

Color ink-jet recording tests on the recording medium were conducted by using the following four inks of different colors to evaluate its recording characteristics:

| | |
|---|---|
| Yellow ink composition | |
| C.I. Acid Yellow 23 | 2 parts |
| Diethylene glycol | 30 parts |
| Water | 70 parts |
| Magenta ink composition | |
| C.I. Acid Red 92 | 2 parts |
| Diethylene glycol | 30 parts |
| Water | 70 parts |
| Cyan ink composition | |
| C.I. Direct Blue 86 | 2 parts |
| Diethylene glycol | 30 parts |
| Water | 70 parts |
| Black ink composition | |
| C.I. Direct Black 19 | 2 parts |
| Diethylene glycol | 30 parts |
| Water | 70 parts |

Results of the evaluation are shown in Table 1, wherein the items and criteria of evaluation are as follows:

(1) The optical density of the ink dot was measured by using Micro-Densitomer PDM-5 (supplied by Konishiroku Photographic Ind. Co., Ltd.).

(2) The shape of the ink dot was observed with a stereo-microscope. A nearly circular shape was marked with o, slightly deformed circular shape with Δ, and irregular shape with x.

(3) The blotting degree (spread degree) of ink dot was represented by the ratio of the diameter of ink dot measured with a stereo-microscope to that of the original ink droplet (4) The brightness of color was evaluated by visual observation of the image formed by ink-jet recording. It was ranked with ⊖, o, Δ, or x in order from good to bad (5) The ink absorptivity was evaluated by applying four ink droplets of different colors to overlap one another and observing the state of the ink dots. When diffusion or bleeding of inks was not observed and the image was distinct, the sample was marked with o. In other cases, the sample was marked with x.

In the following Examples, the evaluation of ink-jet recording characteristic of the samples were conducted in the same manner as described above.

EXAMPLE 2

A coating composition was prepared according to the following formulation:

| Formulation | |
|---|---|
| Calcium carbonate (average particle size 3μ) as filler | 100 parts |
| Starch as binder | 30 parts |
| SBR latex as binder | 10 parts |
| Water | 300 parts |

Then the same common wood-free paper as used in Example 1 was coated with the above composition by means of a blade coater so as to give a dry coating weight of 20 g/m$^2$ and was dried in the usual way, whereby a recording medium was obtained.

Results of evaluating this recording medium are shown in Table 1.

EXAMPLE 3

A coating composition was prepared according to the following formulation:

| Formulation | |
|---|---|
| Talc (average particle size 7μ) as filler | 100 parts |
| Casein as binder | 20 parts |
| Water | 500 parts |

Then the same common wood-free paper as used in Example 1 was coated with the above composition by means of a blade coater so as to give a dry coating weight of 20 g/m$^2$ and was dried in the usual way, whereby a recording medium was obtained.

Results of evaluating this recording medium are shown in Table 1.

COMPARATIVE EXAMPLE 1

A commercial art paper (tradename: SK Coat, mfd. by Sanyo-Kokusaku Pulp Co., Ltd.) was evaluated as a recording medium for ink-jet recording characteristics. Results of the evaluation are shown in Table 1. FIG. 5 is a scanning electron microscopic photograph of magnification factor ca. 1500 showing a face of the coating layer of this paper.

TABLE 1

| Item (Color of used ink) | Example 1 | Example 2 | Example 3 | Comparative Example 1 |
|---|---|---|---|---|
| Optical density of ink dot (Black) | 0.74 | 0.74 | 0.70 | 0.35 |
| Shape of ink dot (Black) | o | o | o | o |
| Blotting degree of ink dot (Black) | 2.5 | 2.7 | 2.6 | 3.5 |
| Brightness of color (Yellow) | ◎ | o | o | x |
| Brightness of color (Red) | ◎ | ◎ | Δ | x |
| Brightness of color (Blue) | ◎ | ◎ | o | x |
| Ink absorptivity | o | o | o | x |

TABLE 1-continued

| Item (Color of used ink) | Example 1 | Example 2 | Example 3 | Comparative Example 1 |
|---|---|---|---|---|
| (Black) | | | | |

EXAMPLE 4

Figure 2:
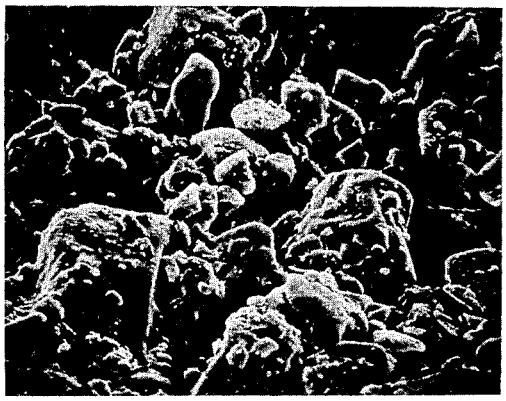

A recording medium was prepared in the same manner as in Example 1 except for using another type of silica (tradename: Syloid 404, average particle size 10μ, mfd. by Fuji-Davison Chem. Co., Ltd.) as filler. FIG. 2 is a scanning electron microscopic photography of magnification factor ca. 1500 showing a face of the coating layer of the recording medium. Results of evaluating recording characteristics of this recording medium are shown in Table 2.

EXAMPLE 5

A coating composition was prepared according to the following formulation:

| Formulation | |
|---|---|
| Diatomaceous earth (tradename: Celite 281, average particle size 8μ, mfd. by John-Manville Co.) as porous inorganic pigment | 100 parts |
| Starch as binder | 30 parts |
| SBR latex as binder | 10 parts |
| Water | 800 parts |

Then the same common wood-free paper as used in Example 1 was coated with the above composition by means of a blade coater so as to give a dry coating weight of 10 g/m$^2$ and was dried in the usual way, whereby a recording medium was obtained. Results of evaluating this recording medium are shown in Table 2.

EXAMPLE 6

A coating composition was prepared according to the following formulation:

| Formulation | |
|---|---|
| Zeolite (tradename: Molecular Sieve 13X, average particle size 10μ, mfd. by Union-Showa Co., Ltd.) as porous inorganic pigment | 100 parts |
| Starch as binder | 20 parts |
| Water | 300 parts |

Then, the same common wood-free paper as used in Example 1 was coated with the above composition by means of a blade coater so as to give a dry coating weight of 20 g/m$^2$ and was dried in the usual way, whereby a recording medium was obtained. Results of the evaluation are shown in Table 2.

TABLE 2

| Item (color of used ink) | Example 4 | Example 5 | Example 6 |
|---|---|---|---|
| Optical density of ink dot (Black) | 0.81 | 0.76 | 0.72 |
| Shape of ink dot (Black) | o | o | o |
| Blotting degree of ink dot (Black) | 2.4 | 2.6 | 2.8 |
| Brightness of color | ◎ | o | o |

TABLE 2-continued

| Item (color of used ink) | Example 4 | Example 5 | Example 6 |
|---|---|---|---|
| (Yellow) | | | |
| Brightness of color (Red) | ◎ | o | Δ |
| Brightness of color (Blue) | ◎ | o | o |
| Ink absorptivity (Black) | o | o | o |

EXAMPLE 7

A coating composition was prepared according to the following formulation:

| Formulation | |
|---|---|
| Silica (tradename: Syloid 404, average particle size 10μ, mfd. by Fuji-Davison Chem. Co., Ltd.) as filler | 100 parts |
| Calcium carbonate (average particle size 2μ) as filler | 15 parts |
| Poly(vinyl alcohol) as binder | 30 parts |
| SBR latex as binder | 3 parts |
| Water | 500 parts |

Figure 3:
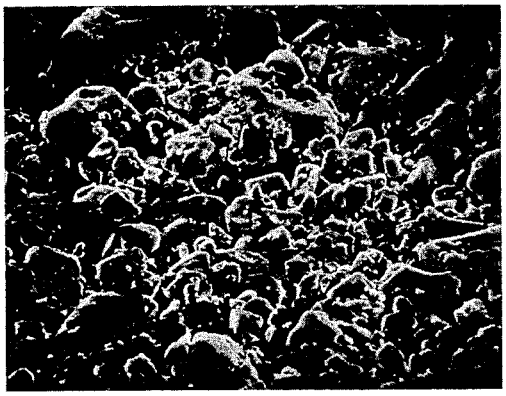

Then, the same common wood-free paper as used in Example 1 was coated with the above composition by means of a blade coater so as to give a dry coating weight of 10 g/m$^2$ and was dried in the usual way, whereby a recording medium was obtained. FIG. 3 is a scanning electron microscopic photography of magnification factor ca. 1500 showing a face of the coating layer of the recording medium.

Results of evaluating recording characteristics and the Bekk smoothness of this recording medium are shown in Table 3. The Bekk smooth was measured by using an Ohken's air permeability - smoothness tester (supplied by Asahi Seiko Co., Ltd.)

EXAMPLE 8

A recording medium was prepared in the same manner as in Example 5 and was evaluated in the same manner as in Example 7. The results are shown in Table 3.

EXAMPLE 9

A coating composition was prepared according to the following formulation:

| Formulation | |
|---|---|
| Zeolite (average particle size 10μ) as filler | 100 parts |
| Talc (average particle size 7μ) as filler | 10 parts |
| Casein as binder | 20 parts |
| Water | 500 parts |

Then, the same common wood-free paper as used in Example 1 was coated with the above composition by means of a bar coater so as to give a dry coating weight of 15 g/m$^2$ and was dried in the usual way, whereby a recording medium was obtained.

Results of evaluating this recording medium in the same manner as in Example 7 are shown in Table 3.

COMPARATIVE EXAMPLE 2

The same commercial art paper as of Comparative Example 1 was evaluated as a recording medium in the same manner as in Example 7. The results are shown in Table 3.

COMPARATIVE EXAMPLE 3

Using calcium carbonate (average particle size 50μ) as filler and poly(vinyl alcohol) as binder, a coating composition was prepared according to the following formulation:

| | |
|---|---|
| Calcium carbonate (average particle size 50μ) as filler | 100 parts |
| Poly(vinyl alcohol) as binder | 5 parts |
| Water | 50 parts |

Then, the same common wood-free paper as used in Example 1 was coated with the above composition by means of a bar coater so as to give a dry coating weight of 15 g/m$^2$ and was dried in the usual way, whereby a recording medium was obtained.

Results of evaluating this recording medium in the same manner as in Example 7 are shown in Table 3.

TABLE 3

| Item (color of used ink) | Example 7 | Example 8 | Example 9 | Comparative Example 2 | Comparative Example 3 |
|---|---|---|---|---|---|
| Bekk smoothness (sec.) | 108 | 28 | 60 | 1200 | 10 |
| Optical density of ink dot (Black) | 0.78 | 0.74 | 0.74 | 0.35 | 0.68 |
| Shape of ink dot (Black) | o | o | o | o | x |
| Blotting degree of ink dot (Black) | 2.5 | 2.6 | 2.6 | 3.5 | 2.8 |
| Brightness of color (Yellow) | ◎ | o | o | x | o |
| Brightness of color (Red) | ◎ | o | Δ | x | ◎ |
| Brightness of color (Blue) | ◎ | o | o | x | ◎ |
| Ink absorptivity (Black) | ◎ | o | o | x | x |

EXAMPLE 10

A coating composition was prepared according to the following formulation:

| Formulation | |
|---|---|
| Silica (average particle size 10μ) as filler | 100 parts |
| Aluminum hydroxide (average particle size 2μ) as filler | 10 parts |
| Poly(vinyl alcohol) as binder | 25 parts |
| SBR latex as binder | 5 parts |
| Water | 400 parts |

Figure 4:
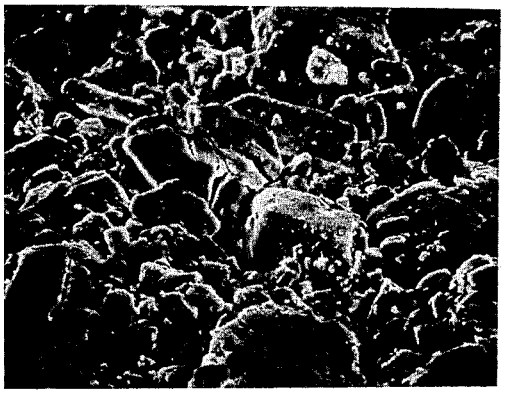

Then, the same common wood-free paper as used in Example 1 was coated with the above composition by means of a blade coater so as to give a dry coating weight of 10 g/m$^2$ and was dried in the usual way, whereby a recording medium was obtained. FIG. 4 is a scanning electron microscopic photography of magnification factor ca. 1500 showing a face of the coating layer of this recording medium.

Results of measuring recording characteristics and surface roughness of this recording medium are shown in Table 4. The surface roughness was measured by using a tester Talysurf 4 (supplied by Taylor-Hobson Co.) in accordance with the measuring method for surface roughness of JIS B0601; that is, maximum heights for a reference length of 2.5 mm were measured at 10 points selected at random on the surface of the ink absorbing layer, and the average value of the found maximum heights was defined as surface roughness.

EXAMPLE 11

A coating composition was prepared according to the following formulation:

| Formulation | |
|---|---|
| Diatomaceous earth (average particle size 8μ) as filler | 100 parts |
| Poly(vinyl alcohol) as binder | 20 parts |
| SBR latex as binder | 10 parts |
| Water | 300 parts |

Then, the same common wood-free paper as used in Example 1 was coated with the above composition by means of a bar coater so as to give a dry coating weight of 15 g/m$^2$ and was dried in the usual way, whereby a recording medium was obtained.

Results of evaluating this recording medium in the same manner as in Example 10 are shown in Table 4.

EXAMPLE 12

A coating composition was prepared according to the following formulation:

| Formulation | |
|---|---|
| Clay (average particle size 1μ) as filler | 80 parts |
| Calcium carbonate (average particle size 20μ) as filler | 20 parts |
| Starch as binder | 15 parts |
| Ethylene-vinyl acetate copolymer emulsion as binder | 5 parts |
| Water | 200 parts |

Then, the same common wood-free paper as used in Example 1 was coated with the above composition by means of a blade coater so as to give a dry coating weight of 20 g/m$^2$ and was dried in the usual way, whereby a recording medium was obtained. Results of evaluating this recording medium in the same manner as in Example 10 are shown in Table 4.

COMPARATIVE EXAMPLE 4

The same commercial art paper as of Comparative Example 1 (SK Coat, mfd. by Sanyo-Kokusaku Pulp Co., Ltd.) was evaluated for ink-jet recording characteristics in the same manner as in Example 10. Results of the evaluation are shown in Table 4.

COMPARATIVE EXAMPLE 5

A coating composition was prepared according to the following formulation:

| Formulation | |
|---|---|
| Calcium carbonate (average particle size 50μ) as filler | 100 parts |
| Plastic pigment (average particle size 0.5μ) as filler | 10 parts |
| Poly(vinyl alcohol) as binder | 2 parts |
| Water | 50 parts |

The same common wood-free paper as used in Example 1 was coated with the above composition by means of a bar coater so as to give a dry coating weight of 25 g/m$^2$ and was dried in the usual way, whereby a recording medium was obtained.

Results of evaluating this recording medium in the same manner as in Example 10 are shown in Table 4.

TABLE 4

| Item (color of used ink) | Example 10 | Example 11 | Example 12 | Comparative Example 4 | Comparative Example 5 |
|---|---|---|---|---|---|
| Surface roughness (μ) | 22 | 19 | 32 | 5 | 44 |
| Optical density of ink dot (Black) | 0.80 | 0.78 | 0.70 | 0.35 | 0.56 |
| Shape of ink dot (Black) | o | o | o | o | x |
| Blotting degree of ink dot (Black) | 2.5 | 2.6 | 2.7 | 3.5 | 2.8 |
| Brightness of color (Yellow) | ◎ | o | Δ | x | o |
| Brightness of color (Red) | ◎ | o | o | x | ◎ |
| Brightness of color (Blue) | ◎ | o | o | x | ◎ |
| Ink absorptivity (Black) | o | o | o | x | x |

EXAMPLE 13

The same coating composition as of Example 7 was prepared. Then, the same common wood-free paper as used in Example 1 was coated with the above composition by means of a blade coater so as to give a dry coating weight of 20 g/m$^2$ and was dried in the usual way, whereby a recording medium was obtained.

The coating surface of this recording medium exhibited a scanning electron microscopic photograph similar to that of FIG. 3.

Results of evaluating ink-jet recording characteristics and ink absorption capacity of this recording medium are shown in Table 5. The ink absorption capacity was determined according to the foregoing method by using an on-demand type of ink-jet recording head which ejects ink droplets through 10 or more nozzles of 50 μϕ aligned at regular intervals of 24/3 mm, by the action of piezo oscillators (driving voltage 60 V, frequency 1 KHz).

EXAMPLE 14

A coating composition was prepared according to the following formulation:

| Formulation | |
|---|---|
| Diatomaceous earth (tradename: Celite White Mist, average particle size, 5.5μ, mfd. by Johns-Manville Co.) as filler | 100 parts |
| Starch as binder | 30 parts |
| SBR latex as binder | 10 parts |
| Water | 800 parts |

The same common wood-free paper as used in Example 1 was coated with the above composition by means of a blade coater so as to give a dry coating weight of 15 g/m$^2$, and was dried in the usual way, whereby a recording medium was obtained.

Results of evaluating this recording medium in the same manner as in Example 13 are shown in Table 5.

EXAMPLE 15

A coating composition was prepared according to the following formulation:

| Formulation | |
|---|---|
| Clay (average particle size 1.1μ) as filler | 80 parts |
| Barium sulfate (average particle size 0.3μ) as filler | 20 parts |
| Casein as binder | 20 parts |
| Water | 250 parts |

The same common wood-free paper as used in Example 1 was coated with the above composition by means of a blade coater so as to give a dry coating weight of 20 g/m$^2$ and was dried in the usual way, whereby a recording medium was obtained.

Results of evaluating this recording medium in the same manner as in Example 13 are shown in Table 5.

EXAMPLE 16

A mixture of 100 parts of 10% aqueous poly (vinyl alcohol) solution and 30 parts of a zeolite powder (tradename: Molecular Sieve 13X, mfd. by Union Carbide Corp.) was ground in a sand mill. A poly (ethylene terephthalate) film 100μ thick was coated with the resulting mixture by means of a rod bar coater to a thickness of 40μ and was dried. This coated film was dipped for 2 minutes in an aqueous citric acid solution adjusted to pH 3, and was rinsed with water and dried. Thus, a recording medium having a porous coating layer was obtained.

Results of evaluating this recording medium in the same manner as in Example 13 are shown in Table 5.

COMPARATIVE EXAMPLE 6

A commercial common printing paper (tradename: Ginkan, mfd. by Sanyo-Kokusaku Pulp Co., Ltd.) was evaluated for ink-jet recording characteristics in the same manner as in Example 13. Results of the evaluation are shown in Table 5.

COMPARATIVE EXAMPLE 7

The same commercial art paper as of Comparative Example 1 (tradename: SK Coat, mfd. by Sanyo-Kokusaku Pulp Co., Ltd.) was evaluated for ink-jet recording characteristics in the same manner as in Example 13. Results of the evaluation are shown in Table 5.

TABLE 5

| Item (color of used ink) | Example 13 | Example 14 | Example 15 | Example 16 | Comparative Example 6 | Comparative Example 7 |
|---|---|---|---|---|---|---|
| Ink absorption capacity in μl/mm$^2$ (Black) | $3.0 \times 10^{-2}$ | $3.2 \times 10^{-2}$ | $1.2 \times 10^{-2}$ | $1.7 \times 10^{-2}$ | $0.4 \times 10^{-2}$ | $0.5 \times 10^{-2}$ |
| Optical density of ink dot (Black) | 0.84 | 0.76 | 0.78 | 0.81 | 0.41 | 0.35 |
| Shape of ink dot (Black) | o | o | o | o | x | o |
| Blotting degree of ink dot (Black) | 2.4 | 2.6 | 2.3 | 2.4 | 3.2 | 3.5 |
| Brightness of color (Yellow, Red, and Blue) | ◎ | o | o | o | Δ | x |

What is claimed is:

1. A recording medium for recording with ink, which comprises a substrate and an ink acceptor on said substrate, the Bekk smoothness of said ink acceptor surface being within a range from 20 to 120 seconds.

2. The recording medium according to claim 1, wherein said ink acceptor comprises a filler and binder, the irregular shapes of said filler appearing at the surface of said ink acceptor.

3. The recording medium according to claim 2, wherein said filler is a porous inorganic pigment.

4. The recording medium according to claim 2, wherein particles sizes of said filler are in a range from 1 to 30μ.

5. The recording medium according to claim 1, wherein said ink acceptor has a porous structure.

6. The recording medium according to any one of claims 1 through 5, inclusive, wherein the surface roughness of said ink acceptor, expressed in the maximum height for a reference length of 2.5 mm, as measured in accordance with JIS B-0601, is in a range from 10 to 35 microns.

7. The recording medium according to claim 6, wherein the Bekk smoothness of said ink acceptor surface is within a range of about 28 to 108 seconds and the surface roughness of said ink acceptor is in a range of about 19 to 32 microns.

8. A method for recording on a material used to bear writing or printing with ink, characterized in that the recording medium comprises an ink acceptor on a substrate, the Bekk smoothness of said ink acceptor surface being within the range from 20 to 120 seconds.

9. The recording method according to claim 8, wherein said ink acceptor comprises a filler and binder, the irregular shapes of said filler appearing at the surface of said ink acceptor.

10. The recording method according to claim 9, wherein said filler is a porous inorganic pigment.

11. The recording method according to claim 9, wherein particle size of said filler are in the range from 1 to 30μ.

12. The recording method according to claim 8, wherein said ink acceptor has a porous structure.

13. The recording method according to any one of claims 8 through 12, inclusive, wherein the surface roughness of said ink acceptor surface expressed in the maximum height for a reference length of 2.5 mm, as measured in accordance with JIS B-0601, is in the range from 10 to 35 microns.

14. The recording method according to claim 13, wherein the Bekk smoothness of said ink acceptor surface is in the range from about 28 to 108 seconds and the surface roughness of said ink acceptor surface is in the range from about 19 to 32 microns.

15. The recording medium for recording with ink, which comprises a substrate and an ink acceptor on said substrate, the surface roughness of said ink acceptor, expressed in the maximum height for a reference length of 2.5 mm, as measured in accordance with JIS B-0601, is in a range from 10 to 35μ.

16. The recording medium according to claim 15, wherein said ink acceptor comprises a filler and a binder, the irregular shapes of said filler appearing at the surface of said ink acceptor.

17. The recording medium according to claim 16, wherein said filler is a porous inorganic pigment.

18. The recording medium according to claim 16, wherein particle sizes of said filler range from 1 to 30μ.

19. The recording medium according to claim 15, wherein said ink acceptor has a porous structure.

20. A method for recording on a material used to bear writing or printing with ink, characterized in that the recording medium comprises an ink acceptor on a substrate, the surface roughness of said ink acceptor surface expressed in the maximum height for a reference length of 2.5 mm, as measured in accordance with JIS B-0601, being in the range from 10 to 35μ.

21. The recording method according to claim 20, wherein said ink acceptor comprises a filler and a binder, the irregular shapes of said filler appearing at the surface of said ink acceptor.

22. The recording method according to claim 21, wherein said filler is a porous inorganic pigment.

23. The recording method claim 21, wherein particle sizes of said filler are in the range from 1 to 30μ.

24. The recording method claim 20, wherein said ink acceptor has a porous structure.

25. A recording medium for recording with ink, which comprises a substrate and an ink acceptor on said substrate, the ink absorption capacity of said recording medium being at least $7.0\times10^{-3}$ μl/mm$^2$.

26. The recording medium according to claim 25, wherein said ink acceptor comprises a filler and a binder, the irregular shapes of said filler appearing at the surface of said ink acceptor.

27. The recording medium according to claim 26, wherein said filler is a porous inorganic pigment.

28. The recording medium according to claim 26, wherein particle sizes of said filler are in a range from 1 to 30μ.

29. The recording medium according to claim 25, wherein said ink acceptor has a porous structure.

30. A method for recording on a material used to bear writing or printing with ink, characterized in that the recording medium comprises an ink acceptor on a substrate, the ink absorption capacity of said recording medium being at least $7.0\times10^{-3}$ μl/mm$^2$.

31. The recording method according to claim 30, wherein said ink acceptor comprises a filler and a binder, the irregular shapes of said filler appearing at the surface of said ink acceptor.

32. The recording method according to claim 31, wherein said filler is a porous inorganic pigment.

33. The recording method according to claim 31, wherein particle sizes of said filler are in the range from 1 to 30μ.

34. The recording method according to claim 30, wherein said ink acceptor has a porous structure.

* * * * *

UNITED STATES PATENT AND TRADEMARK OFFICE

CERTIFICATE OF CORRECTION

PATENT NO. : 4,542,059

DATED : September 17, 1985

INVENTOR(S) : SHIGEO TOGANOH, ET AL.

It is certified that error appears in the above-identified patent and that said Letters Patent is hereby corrected as shown below:

Column 3, line 58, before "paper" insert --plain--.

Column 4, line 60, after "paraffin" insert --.--.

Column 5, line 68, after "recording" insert --.--.

Column 6, line 60, after "droplet" insert --.--; and
line 64, after "bad" insert --.--.

Column 9, line 36, change "smooth" to --smoothness--.

Signed and Sealed this

*Twelfth* Day of *August 1986*

[SEAL]

*Attest:*

DONALD J. QUIGG

*Attesting Officer*

*Commissioner of Patents and Trademarks*